US007549887B1

(12) United States Patent
Ng et al.

(10) Patent No.: US 7,549,887 B1
(45) Date of Patent: Jun. 23, 2009

(54) CONNECTOR

(75) Inventors: Jen Vun Ng, Westland, MI (US); Takayoshi Hirakawa, Novi, MI (US)

(73) Assignee: Yazaki North America, Inc., Canton, MI (US)

( * ) Notice: Subject to any disclaimer, the term of this patent is extended or adjusted under 35 U.S.C. 154(b) by 0 days.

(21) Appl. No.: 12/111,444

(22) Filed: Apr. 29, 2008

(51) Int. Cl.
*H01R 13/627* (2006.01)

(52) U.S. Cl. ..... 439/352; 439/357; 439/489

(58) Field of Classification Search ..... 439/352, 439/353, 357, 489
See application file for complete search history.

(56) References Cited

U.S. PATENT DOCUMENTS

| | | | | |
|---|---|---|---|---|
| 4,880,393 | A | 11/1989 | Moji | |
| 5,637,010 | A | 6/1997 | Jost et al. | |
| 6,027,364 | A | 2/2000 | Fukuda | |
| 6,332,804 | B2 | 12/2001 | Kurimoto et al. | |
| 6,383,009 | B2 | 5/2002 | Kawase et al. | |
| 6,386,915 | B1 | 5/2002 | Nelson | |
| 6,416,346 | B1 | 7/2002 | Nakamura | |
| 6,494,732 | B2 | 12/2002 | Kashiyama et al. | |
| 6,644,996 | B2 | 11/2003 | Yamashita | |
| 6,688,907 | B2 | 2/2004 | Yamaoka et al. | |
| 6,746,158 | B2 | 6/2004 | Merrick | |
| 7,204,712 | B2 | 4/2007 | Schwiebert et al. | |
| 7,275,951 | B2 * | 10/2007 | Shigeta et al. | 439/352 |
| 2002/0151206 | A1 * | 10/2002 | Yeomans et al. | 439/352 |
| 2007/0059969 | A1 | 3/2007 | Shamoto | |
| 2008/0009171 | A1 | 1/2008 | Tsuji | |
| 2008/0139034 | A1 * | 6/2008 | Dieterle et al. | 439/352 |

FOREIGN PATENT DOCUMENTS

| | | |
|---|---|---|
| JP | 04306575 | 10/1992 |

* cited by examiner

*Primary Examiner*—Hien Vu
(74) *Attorney, Agent, or Firm*—Harness, Dickey & Pierce, P.L.C.

(57) ABSTRACT

A connector is provided. The connector can include a first housing that can define a bore for receipt of a first electrical terminal. The first housing can have an outer housing and an inner housing. The inner housing can include a housing lock, and can be moveable relative to the outer housing to enable the housing lock to move from a locked position to an unlocked position. The connector can include a second housing, which can define a bore for receipt of a second electrical terminal. The second housing can include a ramp that engages a portion of the housing lock when the housing lock is in the locked position to move the housing lock into the unlocked position. The ramp can be retained by the housing lock in the locked position to secure the first housing to the second housing.

19 Claims, 9 Drawing Sheets

CONNECTOR

The present disclosure generally relates to an electrical wiring connector, and more particularly to a connector for use in a restricted area, such as in a restricted area of a motor vehicle.

Traditionally, electrical connectors can be used to couple, join or electrically connect various electrical components together to enable data, current, etc. to flow between the electrical components. For example, an electrical component can include one or more electrical wires, which can be joined together at a terminal. The terminal can be configured to mate with a corresponding terminal, in a male-female fashion. The electrical connector can facilitate the engagement of the male terminal with the female terminal, and the electrical connector can be configured to resist the disengagement of the female terminal with the male terminal.

Generally, in-line electrical connectors can be used in motor vehicles due to their compact size. A typical in-line connector can include a male housing that can surround a male terminal, and a female housing that can surround a female terminal. Generally, the female housing can include a housing lock to prevent the accidental disengagement of the male housing from the female housing, and thus, the male terminal from the female terminal. Typically, in order to disengage the male housing from the female housing with this type of in-line connector, an operator has to use a tool or his or her thumb to deflect the housing lock on the female housing, while at the same time pulling the female housing away from the male housing. This can be difficult to perform in a restricted area such as in a restricted area of a motor vehicle.

A connector is provided. The connector can include a first housing that can define a bore for receipt of a first electrical terminal. The first housing can have an outer housing and an inner housing. The inner housing can include a housing lock, and can be moveable relative to the outer housing to enable the housing lock to move from a first, locked position to a second, unlocked position. The connector can also include a second housing, which can define a bore for receipt of a second electrical terminal. The second housing can include a ramp that engages a portion of the housing lock when the housing lock is in the locked position to move the housing lock into the unlocked position to enable the second electrical terminal to engage the first electrical terminal. The housing lock can return to the locked position after the engagement of the first electrical terminal with the second electrical terminal, with the ramp retained by the housing lock in the locked position to secure the first housing to the second housing.

Further provided is a connector. The connector can include a male housing, which can surround a male terminal at a distal end. The male housing can have a proximal end that includes a ramp. The connector can also include a first female housing, which can surround a female terminal. The first female housing can include a housing lock cantilevered relative to the first female housing, which can be movable between a locked position and an unlocked position. The first female housing can include a tab that extends from a surface opposite the housing lock. The connector can also include a second female housing, which can surround at least a portion of the first female housing. The second female housing can define an aperture on a first surface and can include at least one ramp that extends into the aperture. The second female housing can define a slot on a surface opposite the aperture that receives the tab to enable the first female housing to move relative to the second female housing. The aperture and the at least one ramp can cooperate with the housing lock to move the housing lock from the locked position to the unlocked position when the first female housing moves from a first position to a second position relative to the second female housing.

In one of various embodiments, a connector is provided. The connector can include a male housing, which can surround a male terminal at a distal end. The male housing can have a proximal end that includes a ramp. The connector can also include a first female housing, which can surround a female terminal. The first female housing can include a housing lock cantilevered relative to the first female housing, which can be movable between a locked position and an unlocked position. The housing lock can include a ramped portion. The first female housing can also include a tab that extends from a surface opposite the housing lock. The connector can include a second female housing, which can surround at least a portion of the first female housing. The second female housing can define an aperture on a first surface and can include at least one ramp that extends into the aperture. The second female housing can define a slot on a surface opposite the aperture that can receive the tab to enable the first female housing to move relative to the second female housing. The ramp of the male housing can contact the ramped portion of the housing lock to move the housing lock from the locked position to the unlocked position upon the insertion of the male housing into the first female housing. The aperture and the at least one ramp of the second female housing can cooperate with the ramped portion to move the housing lock from the locked position to the unlocked position when the ramp of the male housing is pulled away from the first female housing, and thereby moves the first female housing from a first position to a second position relative to the second female housing, to release the male housing from the first female housing.

Further areas of applicability of the present teachings will become apparent from the detailed description provided hereinafter. It should be understood that the description and specific examples, while indicating various embodiments of the present teachings, are intended for purposes of illustration only and are not intended to limit the scope of the present teachings.

BRIEF DESCRIPTION OF THE DRAWINGS

The present teachings will become more fully understood from the detailed description and the accompanying drawings, wherein.

DETAILED DESCRIPTION

The following description of various embodiments is merely exemplary in nature and is in no way intended to limit the present teachings. Although the following description is related generally to a connector, such as an in-line connector for use to releasably connect a male terminal with a female terminal, it will be understood that the connector, as described and claimed herein, can be used in combination with any appropriate system, component or device where it is desirable to secure two objects together, but can enable disengagement of the two objects with one motion, such as in coupling a plug-and-play device to a computing device. Therefore, it will be understood that the following discussions are not intended to limit the scope of the appended claims.

Figure 1:
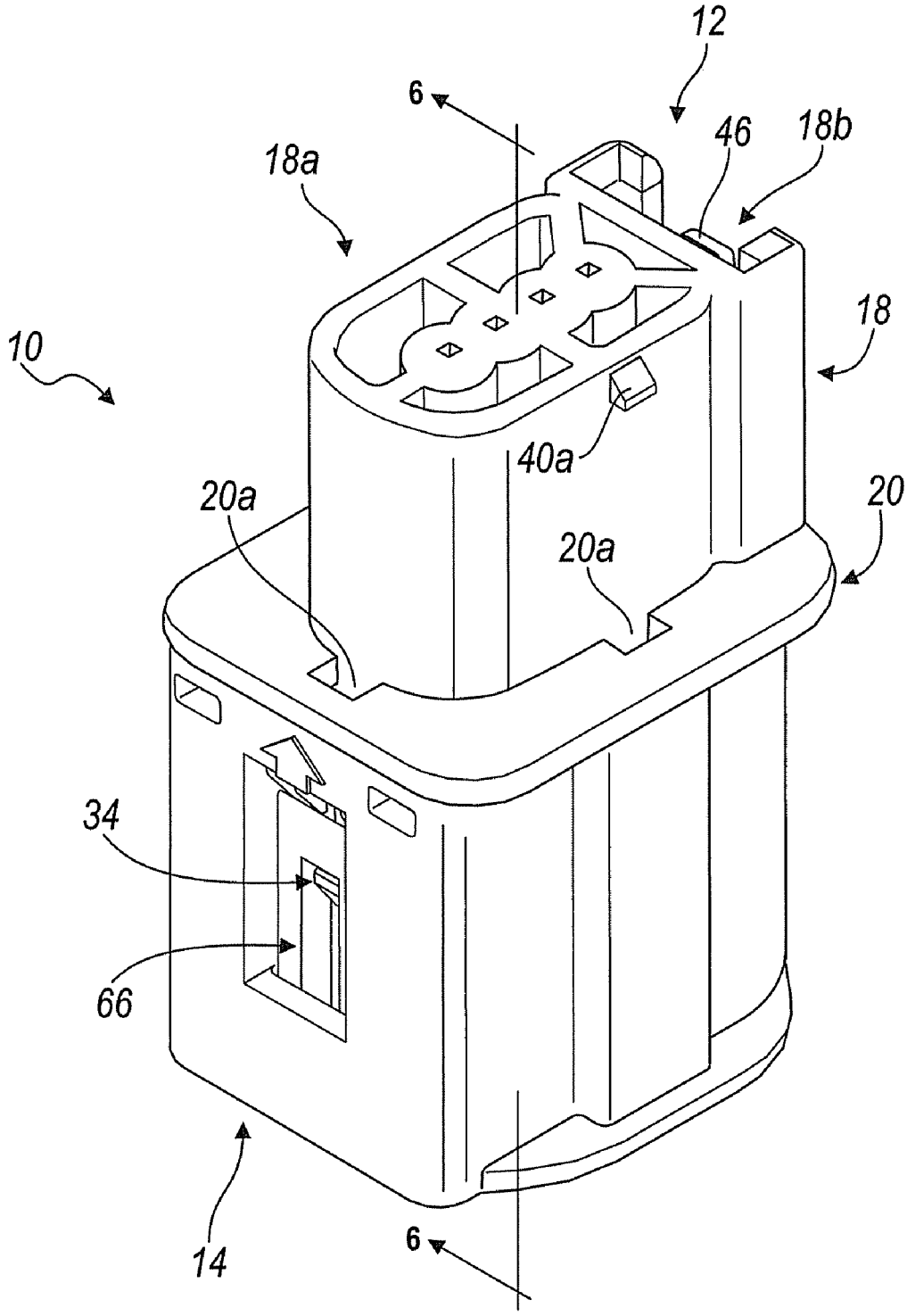
FIG. 1 is a perspective view of a connector according to various teachings.

With reference to FIG. 1, an exemplary connector 10 is shown. The connector 10 can include a male housing 12 and a female housing 14. With additional reference to FIG. 2, the male housing 12 can enclose a male terminal 12*a*, and the female housing 14 can enclose a female terminal 14*a*. The male housing 12 can be releasably coupled to the female housing 14, such that the male terminal 12*a* may not be accidentally disconnected from the female terminal 14*a*, but the male terminal 12*a* can still be disconnected from the female terminal 14*a* using one motion. By enabling the disconnection of the connector 10 with one motion of the operator, it can facilitate the use of the connector 10 in restricted, low clearance areas, such as in trim panels of a motor vehicle. As the male terminal 12*a* and the female terminal 14*a* can comprise any desirable electrical terminal known in the art, the male terminal 12*a* and the female terminal 14*a* will not be discussed in great detail herein. Further, for the sake of clarity, the electrical wiring associated with each of the male terminal 12*a* and the female terminal 14*a* has been simplified. In this regard, with brief reference to FIG. 6, the male terminal 12*a* can include a wire $w_1$ and a contact $c_1$, while the female terminal 14*a* can include a wire $w_2$ and a contact $c_2$. When mated or engaged, the contacts $c_1$, $c_2$ can enable electrical communication over the wires $W_1$, $w_2$. Each of the male housing 12 and the female housing 14 can be composed of a suitable electrically insulative material, such as a polymer, and can be manufactured through any suitable technique, such as injection molding.

Figure 5:
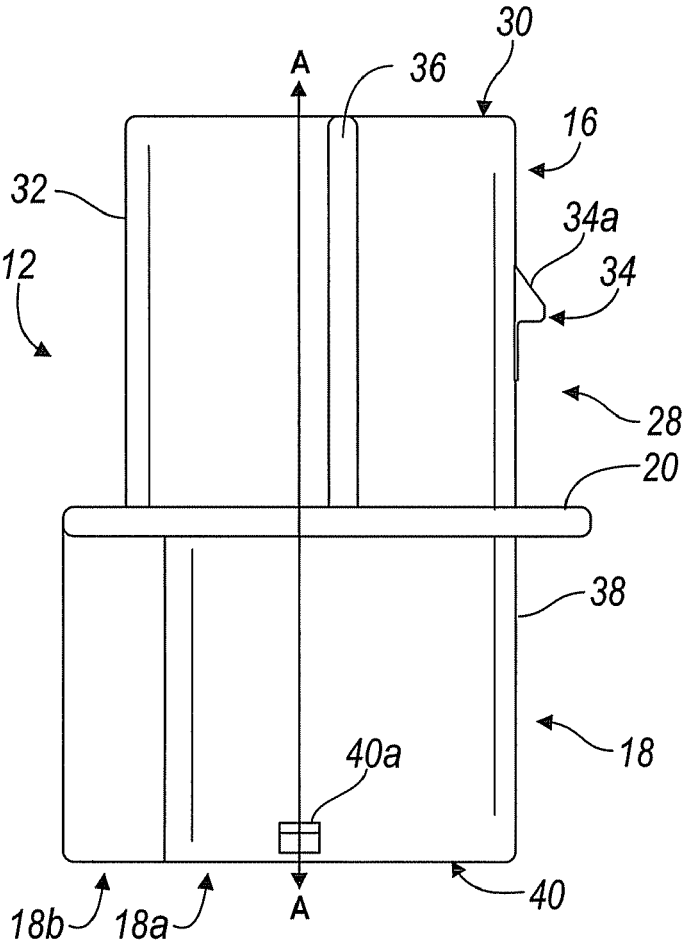
FIG. 5 is a side view of the first, male housing of FIG. 3.
Figure 6:
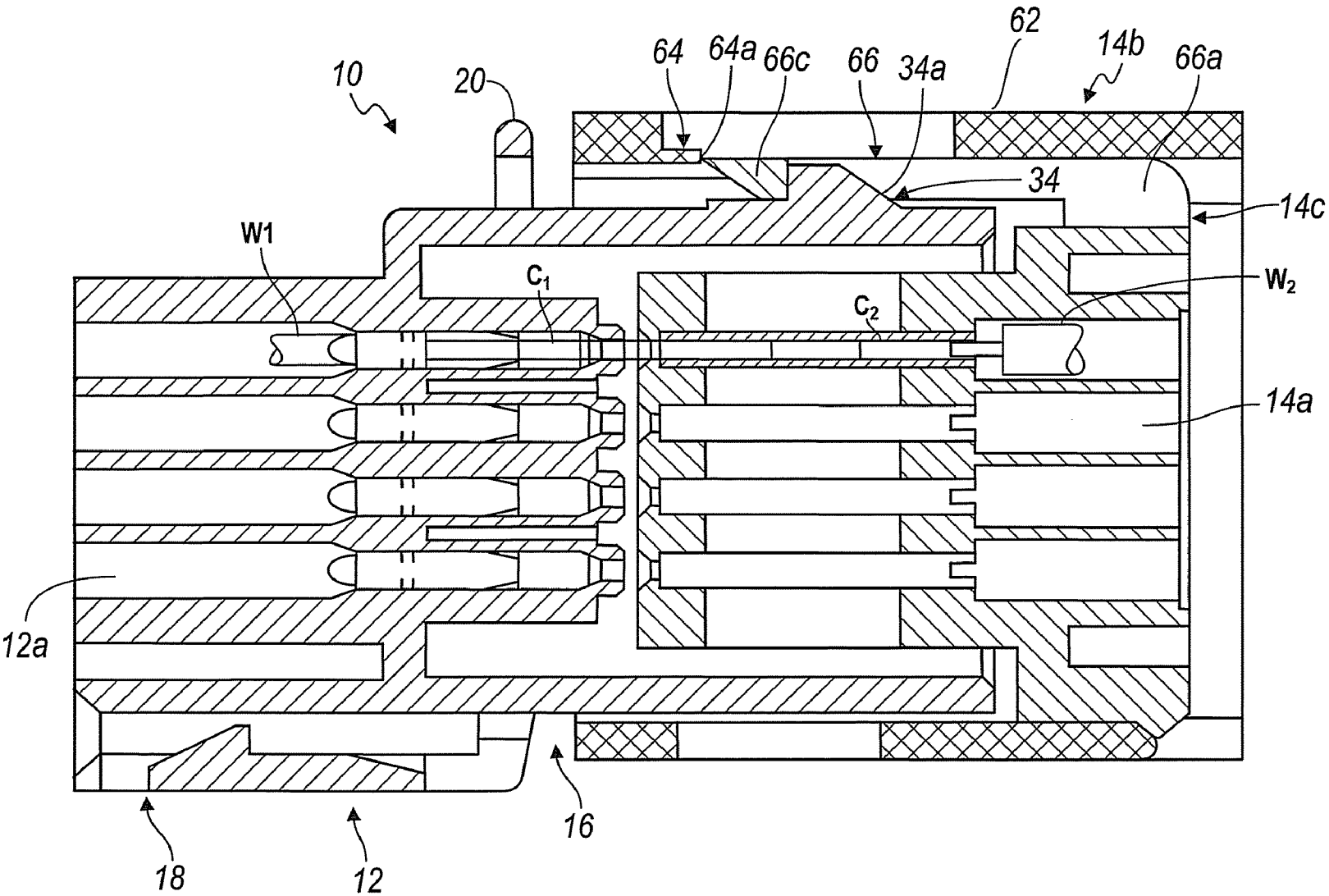
FIG. 6 is a cross-sectional view of the connector of FIG. 1, taken along line 6-6 of FIG. 1, and illustrating the connector in a first position.

With reference to FIGS. 1-5, the male housing 12 can include a proximal end 16, a distal end 18 and a wall 20. The proximal end 16 can be configured to mate with the female housing 14, and can be generally tubular in shape to define a bore 22. The bore 22 can receive a portion of the female housing 14, as will be discussed. The male terminal 12*a* can also be retained in a portion of the bore 22, such that the male terminal 12*a* can be positioned within the distal end 12, and contacts $c_1$ (FIG. 6) from the male terminal 12*a* can extend into the proximal end 16 as shown in FIG. 6. With reference to FIGS. 1-5, the proximal end 16 can also include a top surface 28, sidewalls 30, and a bottom surface 32.

The top surface 28 can include a ramp 34. The ramp 34 can project upwardly from the top surface 28, and can have a sloped surface 34*a*. The sloped surface 34*a* can be formed at an angle between 10 and 80 degrees relative to the top surface 28. The ramp 34 can facilitate the disengagement of the male housing 12 from the female housing 14, as will be discussed.

The sidewalls 30 can extend from the top surface 28 to the bottom surface 32. Each of the sidewalls 30 can include at least one rail 36. The rail 36 can extend longitudinally along each sidewall 30, perpendicular to the wall 20. The rails 36 can be integrally formed with the sidewall 30, and can generally be formed offset from a central longitudinal axis A of each of the sidewalls 30 (FIG. 5). The rails 36 can assist in guiding the male housing 12 into engagement with the female housing 14, as will be discussed. The bottom surface 32 can be generally smooth, to facilitate the engagement of the male housing 12 with the female housing 14.

The distal end 18 of the male housing 12 can include a housing 18*a* and a flange 18*b*. The housing 18*a* can enclose the male terminal 12*a*, and can be generally tubular or cylindrical. The housing 18*a* can include a top surface 38, sidewalls 40 and a bottom surface 42. The top surface 38 can be generally smooth, and the sidewalls 40 can connect the top surface 38 to the bottom surface 42. The sidewalls 40 can also include tabs 40*a*. The tabs 40*a* can enable the connector 10 to be coupled to another vehicle component, such as a wire shield or routing cover for the connector 10.

The flange 18*b* can be coupled to or integrally formed with the bottom surface 42 of the male housing 12. The flange 18*b* can include a slot 44 and a locking arm 46. The slot 44 and locking arm 46 can cooperate to secure the male housing 12 to a support structure, such as a trim panel of a motor vehicle or a bulkhead connector. Thus, the flange 18*b* can act as a clip, to secure the connector 10 to an appropriate support structure.

The wall 20 can separate the proximal end 16 from the distal end 18. The wall 20 can extend upward and outwardly from the flange 18*b*, such that the wall 20 can substantially annularly surround the male housing 12. The wall 20 can prevent the accidental disengagement of the male housing 12 from the female housing 14, as will be discussed herein. The wall 20 can also include apertures 20*a*, which can facilitate the formation of the male housing 12. In this regard, the apertures 20*a* can enable a unidirectional injection molding tooling to form or mold the tabs 40*a*.

Figure 2:
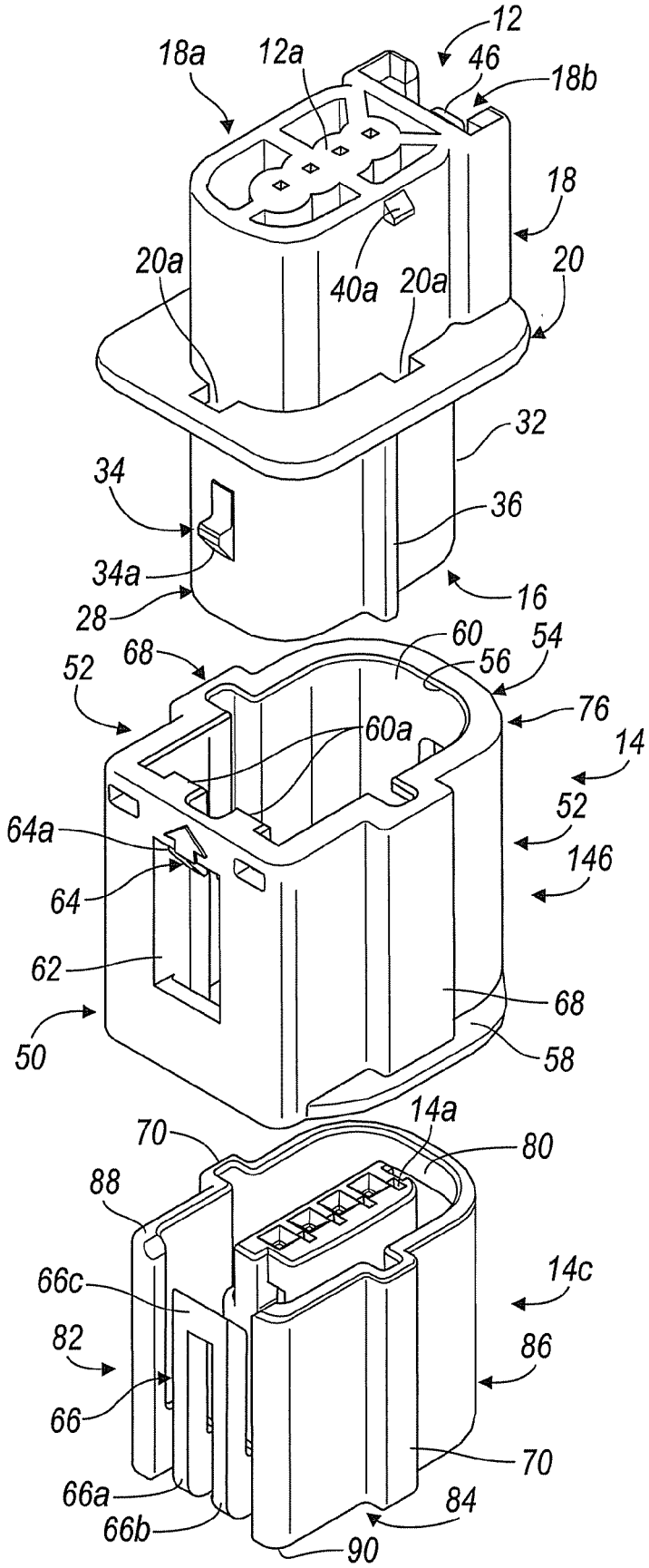
FIG. 2 is an exploded view of the connector of FIG. 1.
Figure 3:
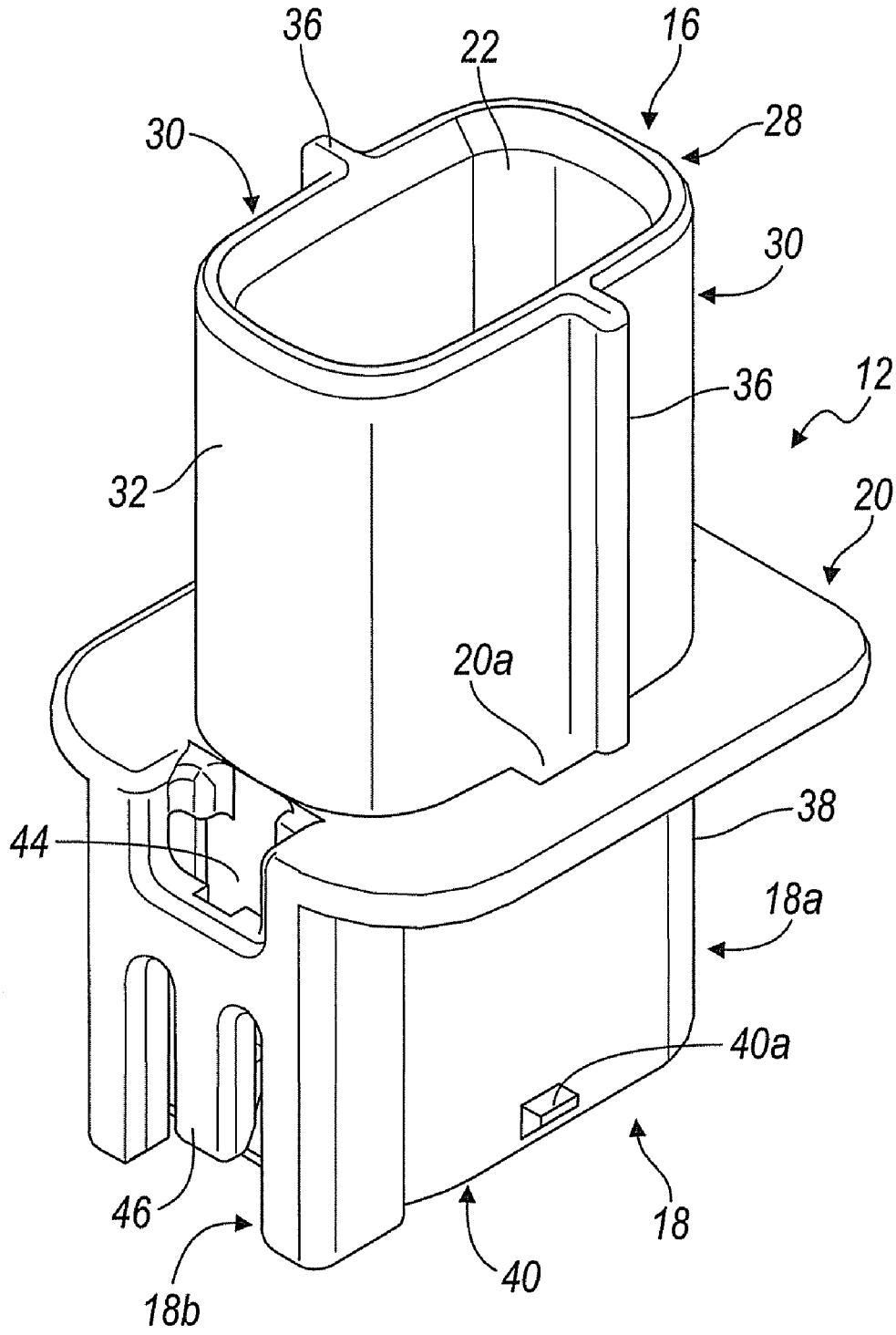
FIG. 3 is a perspective view of a first, male housing of the connector of FIG. 1.
Figure 4:
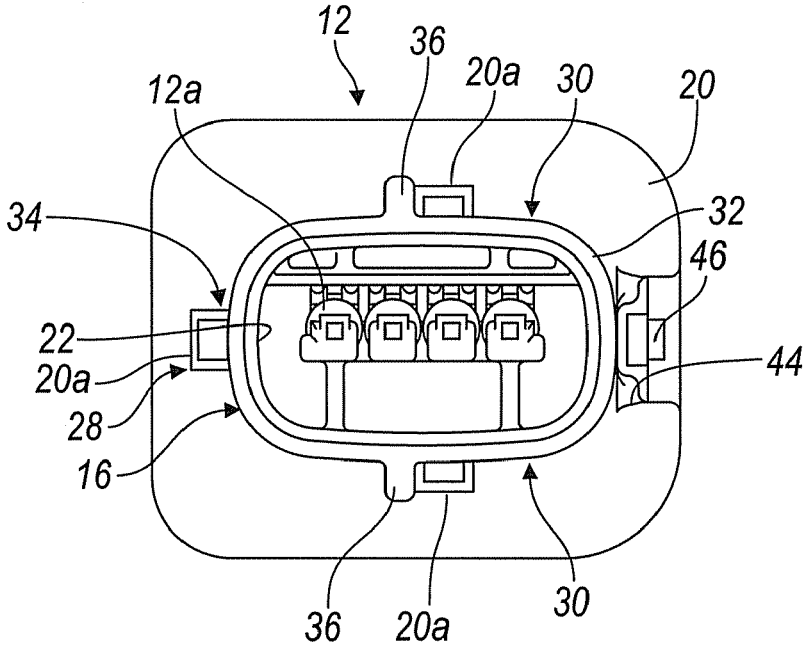
FIG. 4 is a front view of the first, male housing of FIG. 3.

With reference to FIGS. 1 and 2, the female housing 14 can mate with the male housing 12 such that the male housing 12 can be securely connected, but easily disconnected, from the female housing 14. The female housing 14 can include an outer housing 14*b* and an inner housing 14*c*. The outer housing 14*b* can surround the inner housing 14*c*, and the inner housing 14*c* can surround the female terminal 14*a*. The inner housing 14*c* can translate or move linearly within the outer housing 14*b* to facilitate the engagement and disengagement of the male housing 12 with the female housing 14, as will be discussed. With reference to FIGS. 1-2 and 7-8, the outer housing 14*b* can include a top surface 50, sidewalls 52, a bottom surface 54, a lip 56 and a projection 58. The outer housing 14*b* can also define a bore 60. The bore 60 can enable the receipt of the inner housing 14*c*, and can include one or more guides 60*a*. The guides 60*a* can control or guide the translation or movement of the inner housing 14*c* relative to the outer housing 14*b*.

Figure 8:
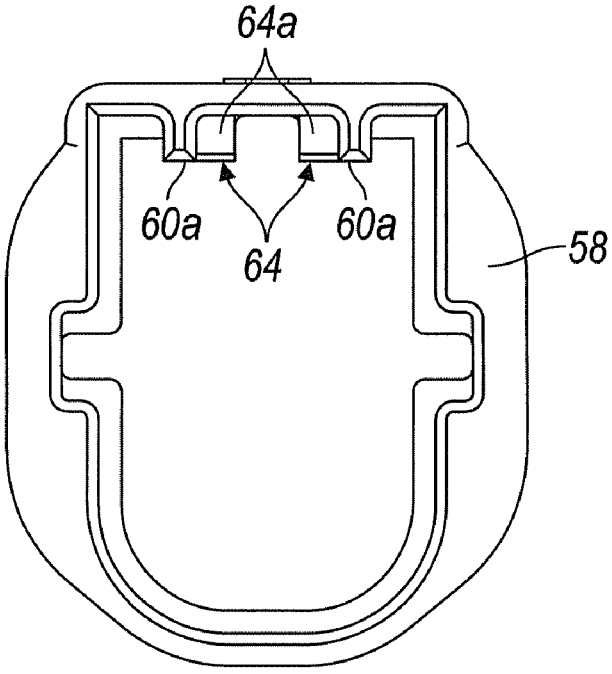
FIG. 8 is a rear side view of the first, female housing of FIG. 7.

With reference to FIG. 2, the top surface 50 can include an aperture 62 and one or more ramps 64. The aperture 62 can be sized to enable a housing lock 66 coupled to the inner housing 14*c* to move upwardly without interference from the outer housing 14*b*. With reference to FIGS. 6 and 8, the ramps 64 can extend below a surface of the aperture 62, at a first end 62*a* of the aperture 62, and can include a sloped surface 64*a*. The sloped surface 64*a* can engage the housing lock 66 to move or bias the housing lock 66 out of an engaged position, as will be discussed herein. As will be discussed, the ramps 64 can enable the male housing 12 to be disconnected from the female housing 14 in one motion.

With reference to FIGS. 1-2 and 7-8, the sidewalls 52 of the outer housing 14*b* can one or more grooves 68. The grooves 68 can project outwardly from the sidewalls 52 to enable receipt of corresponding grooves 70 from the inner housing 14*c* (FIG. 2). The grooves 68 can be generally U-shaped, and can be sized to slidably receive the grooves 70 of the inner housing 14*c* such that the inner housing 14*c* can move or translate within the outer housing 14*b*.

Figure 7:
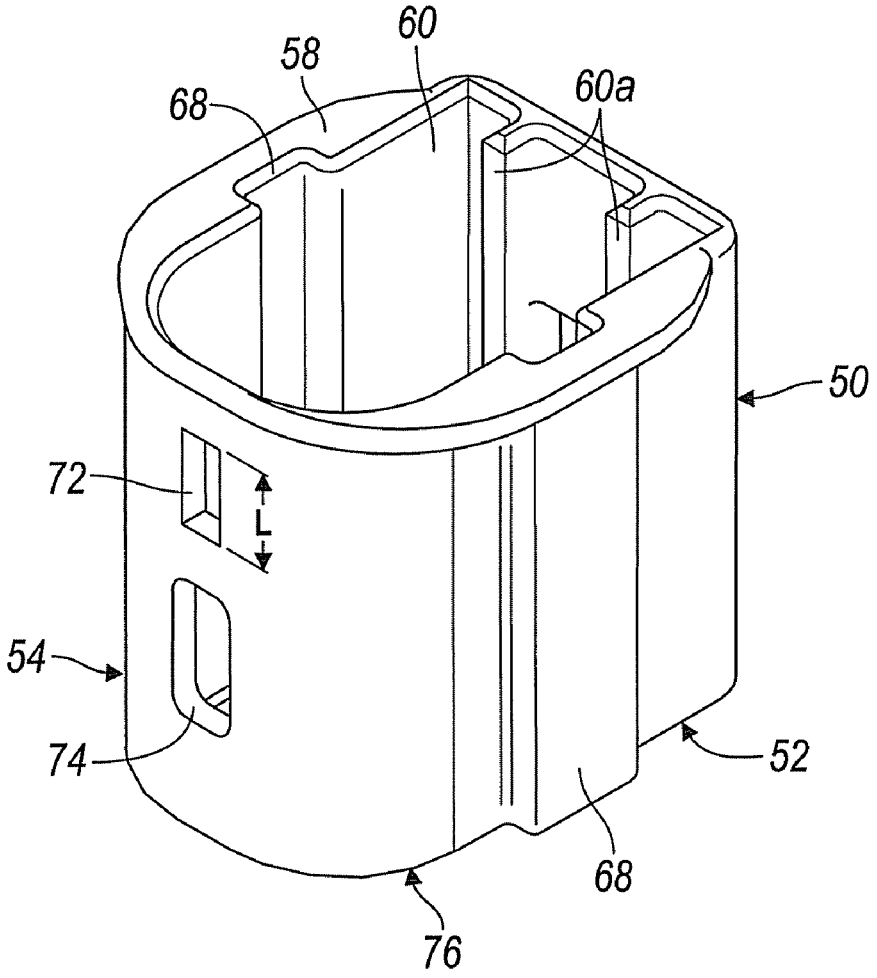
FIG. 7 is a perspective view of a first, female housing of the connector of FIG. 1.

The bottom surface 54 can define a slot 72 and an aperture 74 (FIG. 7). The slot 72 can limit the motion or translation of the inner housing 14*c*, and thus, can have a length L substantially equivalent to the desired distance of travel of the inner housing 14*c* within the outer housing 14*b*. The aperture 74 can provide access to enable a tool to be inserted into the female housing 14 to service a terminal spacer (not specifically shown), which can be coupled to the female terminal 14*a*.

The lip 56 can be formed at a proximal end 76 of the outer housing 14*b* (FIG. 2). The lip 56 can prevent the inner housing 14*c* from being removed from within the outer housing 14*b* when the male housing 12 is disconnected from the female housing 14. Thus, the lip 56 can retain the inner housing 14*c* within the outer housing 14*b*, and generally, the inner housing 14*c* can move into contact with the lip 56 as the male housing 12 is removed from the female housing 14.

As shown in FIGS. 2 and 7, the projections 58 can extend from the sidewalls 52, at a distal end 78 of the outer housing 14*b*. The projections 58 can provide a surface to which a user can grip to facilitate the disengagement of the male housing 12 from the female housing 14. The projections 58 can have any desired shape and width to facilitate the disengagement of the male housing 12 from the female housing 14. Further, the projections 58 can also be used as lock provision for a wire shield or routing cover.

Figure 9:
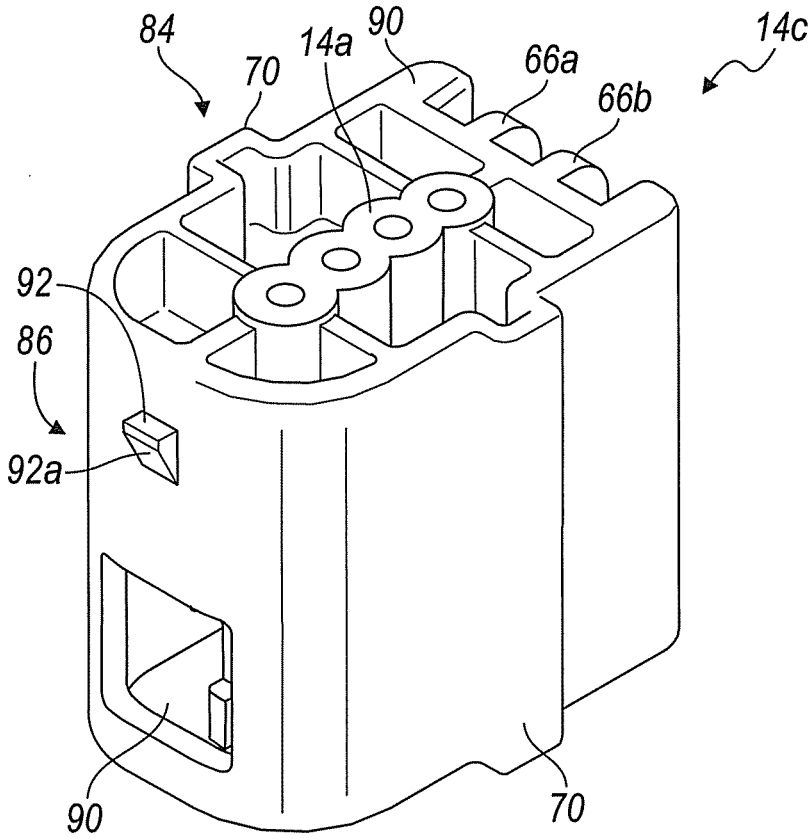
FIG. 9 is a perspective view of a second, female housing of the connector of FIG. 1.

With reference to FIGS. 2, 8 and 9, the inner housing 14*c* can be retained within the outer housing 14*b*, and can move or linearly translate relative to the outer housing 14*b* to facilitate the disconnection of the male housing 12 from the female housing 14. The inner housing 14*c* can define a bore 80 that can receive the female terminal 14*a*. The female terminal 14*a* can generally be formed with the inner housing 14*c*, however, the female terminal 14*a* could be coupled to the inner housing 14*c* and/or outer housing 14*b* in any desired manner. The female terminal 14*a* can be positioned within a center of the bore 80 such that the male terminal 12*a* can be inserted around the female terminal 14*a* to facilitate electrical communication between the male terminal 12*a* and the female terminal 14*a*. The inner housing 14*c* can also include a top surface 82, sidewalls 84 and a bottom surface 86.

The top surface 82 can define the housing lock 66. In one of various embodiments, the housing lock 66 can include a first arm 66*a* joined to a second arm 66*b* via a ramped portion 66*c*. The first arm 66*a* and second arm 66*b* can be coupled to the ramped portion 66*c* such that the ramped portion 66*c* is positioned at a first end 88 of the inner housing 14*c*. The first arm 66*a* and second arm 66*b* can be coupled to a second end 90 of the inner housing 14*c* such that the first arm 66*a* and second arm 66*b* can be cantilevered with respect to the inner housing 14*c*. The ramped portion 66*c* can have a downward or negative slope, which can slidably engage the sloped surface 64*a* of the ramps 64 of the outer housing 14*b* as the inner housing 14*c* moves or translates with respect to the outer housing 14*b*, as shown in FIG. 6. The engagement of the ramped portion 66*c* with the ramps 64 of the outer housing 14*a* can move or bias the first arm 66*a* and second arm 66*b* upward from a first, resting or locked position to a second, deflected or unlocked position, though the aperture 62 to release the male housing 12*a* from the female housing 14.

In this regard, as will be discussed, the first arm 66*a* can be spaced apart from the second arm 66*b* via the ramped portion 66*c* so that the ramp 34 of the male housing 12 can be retained within the space defined between the first arm 66*a* and the second arm 66*b* (FIG. 1). The upward movement of the first arm 66*a* and second arm 66*b* thereby releases the ramp 34 of the male housing 12 from within the housing lock 66, allowing the male housing 12 to be removed from the female housing 14 (or vice versa).

Figure 10:
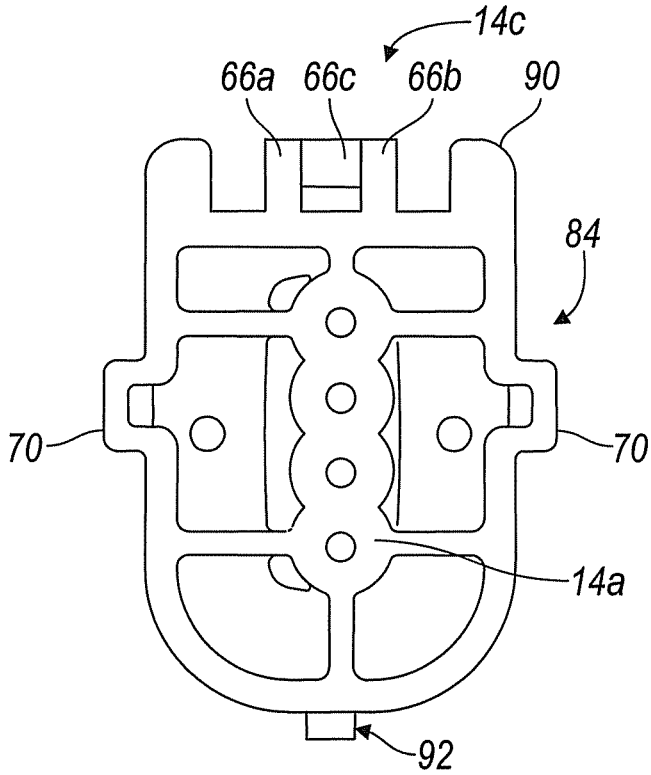
FIG. 10 is a rear side view of the second, female housing of FIG. 9.

With reference to FIGS. 2, 9 and 10, the sidewalls 84 can extend from the top surface 82 to the bottom surface 86. The sidewalls 84 can include the grooves 70. The grooves 70 can be U-shaped, and can receive the rails 36 of the male housing 12. The grooves 70 can generally be sized to slidably receive the rails 36 to enable the male housing 12 to be releasably coupled to the female housing 14.

The bottom surface 86 can include an aperture 90 and a tab 92. The aperture 90 can also enable access to the terminal spacer such that a tool can be inserted through the aperture 90 to service the terminal spacer and/or to insert a terminal spacer (not specifically shown). The tab 92 can be received within the slot 72 of the outer housing 14*b*. The tab 92 can guide the movement or linear translation of the inner housing 14*c* within the outer housing 14*b*, and can also include a sloped surface 92*a*. The sloped surface 92*a* can have a positive or upward slope to maximize the linear translation of the inner housing 14*c*, while allowing the tab 92 to act as a stop to prevent the inner housing 14*c* from being pulled rearwardly out of the outer housing 14*b*.

Figure 11:
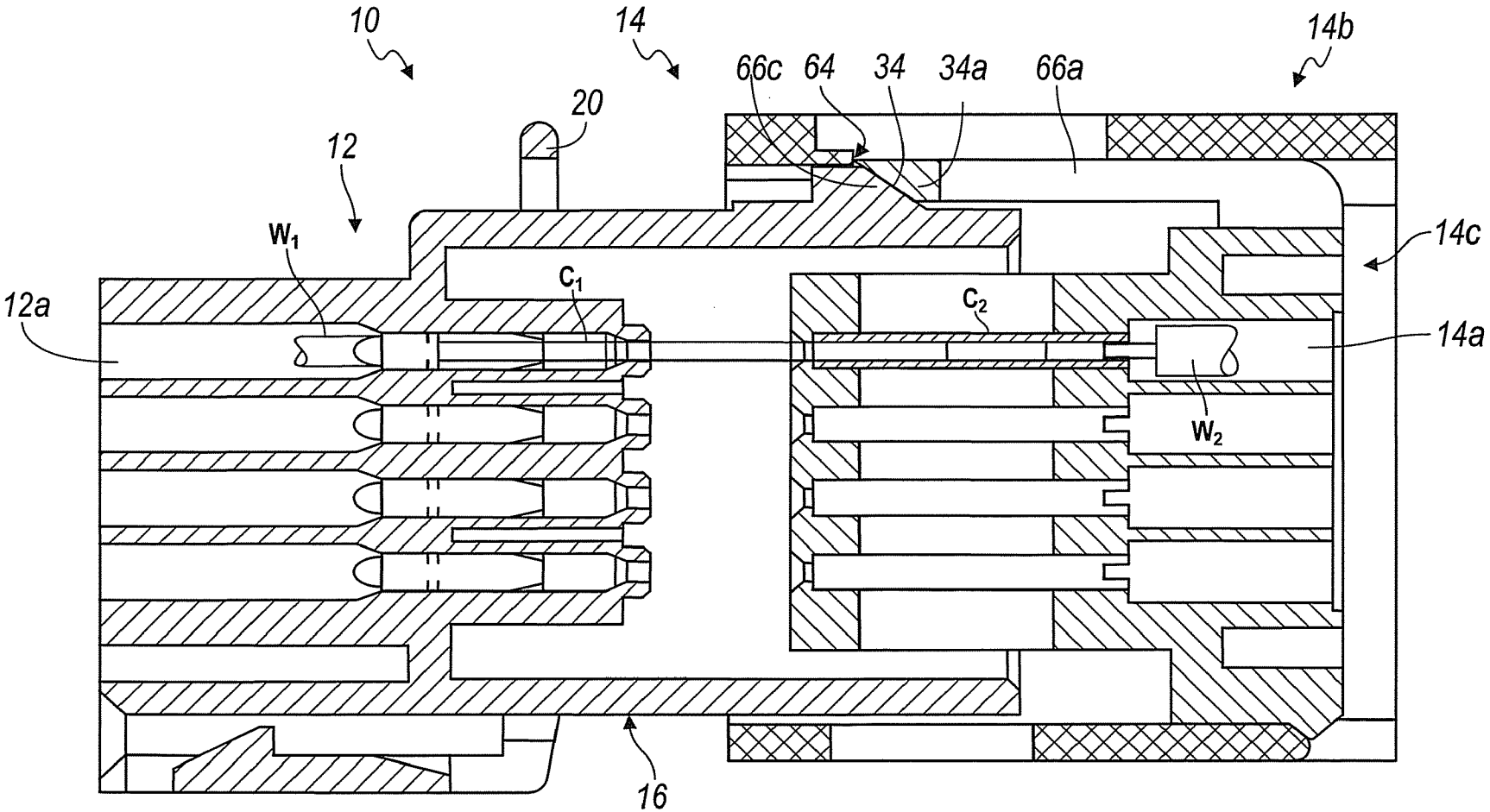
FIG. 11 is a cross-sectional view of the connector of FIG. 1, taken along line 6-6 of FIG. 1, and illustrating the connector in a second position.
Figure 12:
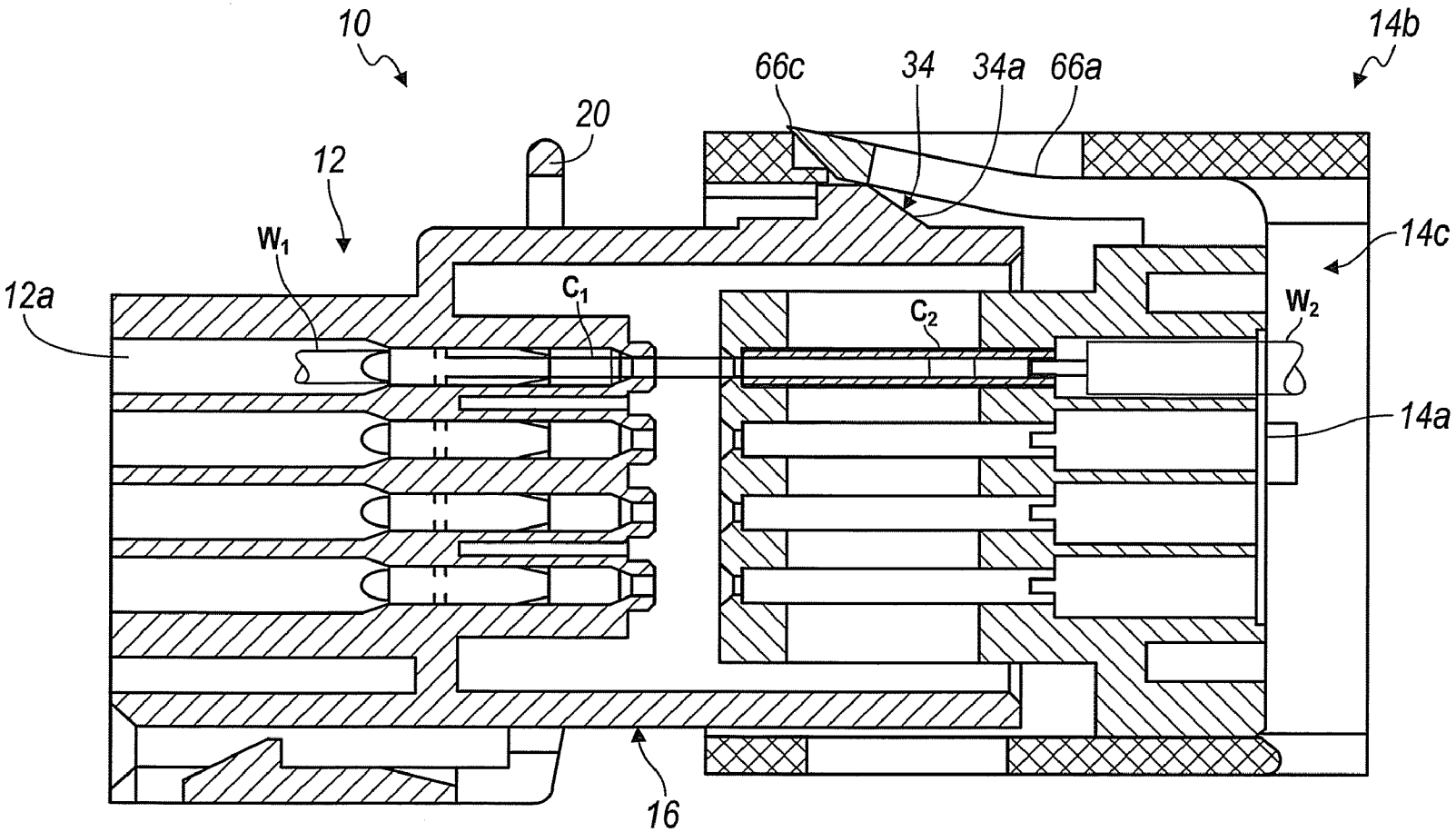
FIG. 12 is a cross-sectional view of the connector of FIG. 1, taken along line 6-6 of FIG. 1, and illustrating the connector in a third position.

With reference to FIGS. 6, 11 and 12, in order to assemble the connector 10, the male housing 12 can be aligned with the female housing 14. In this regard, with reference to FIGS. 2 and 11, the proximal end 16 of the male housing 12 can be positioned within the bore 60 of the outer housing 14*b*, such that the rails 36 can be received within the grooves 70 of the inner housing 14*c*. Generally, the proximal end 16 can be inserted with minimal force until the proximal end 16 is adjacent to and in contact with the ramped portion 66*c* of the housing lock 66 of the inner housing 14*c*.

Then, with reference to FIGS. 2 and 12, the proximal end 16 of the male housing 12 can be further pushed towards the housing lock 66 such that the ramp 34 of the male housing 12 can contact the ramped portion 66*c* of the housing lock 66. The sloped surface 34*a* of the ramp 34 can cooperate with the downward slope of the ramped portion 66*c* to slide the housing lock 66 upward, thereby deflecting the arm 66*a* of the housing lock 66 though the aperture 62 of the outer housing 14*c*. With the housing lock 66 deflected outwardly, the male housing 12 can be pushed further into the inner housing 14*c* such that the male terminal 12*a* is electrically coupled with the female terminal 14*a*, as shown in FIG. 6. By pushing the male housing 12 further into the female housing 14, the ramp 34 of the male housing 12 can enter a cavity 66*d* defined by the arms 66*a*, 66*b*, and thus, cause the housing lock 66 to return to a resting position. With the ramp 34 disposed within the cavity 66*d*, the male housing 12 can be securely coupled to the female housing 14. In addition, the wall 20 of the male housing 12 can prevent the accident disengagement of the male housing 12 from the female housing 14.

In order to disengage the male housing 12 from the female housing 14, with reference to FIGS. 2 and 11, the operator can grip the female housing 14 via the projections 58, or about the grooves 68 and can grip the male housing 12 via the distal end 18. It will be understood, however, that this disengagement procedure described herein is merely exemplary, and for example, if the male housing 12 is fixed on a support structure, disconnection can be accomplished by moving the female housing 14 out of male housing 12 or vice versa. Then, the operator can apply a force to the male housing 12 to pull the male housing 12 from the female housing 14. The application of a force to the male housing 12 can pull both the male housing 12 and the inner housing 14*c* rearward, and can cause the ramped portion 66*c* of the housing lock 66 to contact the sloped surface 64*a* of the ramp 64. The contact between the sloped surface 64*a* and the ramped portion 66*c* can bias the housing lock 66 from the resting position to a deflected position through the aperture 62. With the housing lock 66 in the deflected position, the male housing 12 can be removed from the female housing 14. Then, the housing lock 66 can return to the resting position, as shown in FIG. 11, to enable the re-engagement of the female housing 14 with the male housing 12. Thus, the connector 10 can enable the operator to engage and disengage the connector 10 easily, and with one-motion. This can enable the use of the connector 10 in restricted areas, such as in trim panels of motor vehicles.

While specific examples have been described in the specification and illustrated in the drawings, it will be understood by those of ordinary skill in the art that various changes may be made and equivalents may be substituted for elements thereof without departing from the scope of the present disclosure as defined in the claims. Furthermore, the mixing and matching of features, elements and/or functions between various examples is expressly contemplated herein so that one of ordinary skill in the art would appreciate from this disclosure that features, elements and/or functions of one example may be incorporated into another example as appropriate, unless described otherwise, above. Moreover, many modifications may be made to adapt a particular situation or material to the teachings of the present disclosure without departing from the essential scope thereof. Therefore, it is intended that the present disclosure not be limited to the particular examples illustrated by the drawings and described in the specification as the best mode presently contemplated for carrying out this invention, but that the scope of the present disclosure will include any embodiments falling within the foregoing description and the appended claims.

For example, while the connector 10 has been described as being used to releasably secure a male terminal and female terminal connection, those of skill in the art will appreciate that the present disclosure, in its broadest aspects, may be constructed somewhat differently. For example, the connector 10 could be used to releasably secure a coaxial cable to an audio/video connection of a suitable device. In this regard, the male housing 12 could receive a coaxial cable, and the female housing 14 could surround an audio/video connection, and the engagement of the male housing 12 with the female housing 14 could permit data transfer from the coaxial cable to the device, such as a television, computer, etc.

What is claimed is:

1. A connector comprising:

a first housing that defines a bore for receipt of a first electrical terminal, the first housing having an outer housing and an inner housing, the inner housing including a housing lock, the inner housing moveable relative to the outer housing to enable the housing lock to move from a first, locked position to a second, unlocked position;

a second housing that defines a bore for receipt of a second electrical terminal, the second housing including a ramp having a sloped surface that engages a portion of the housing lock when the housing lock is in the locked position to move the housing lock into the unlocked position to enable the second electrical terminal to engage the first electrical terminal; and wherein the housing lock returns to the locked position after the engagement of the first electrical terminal with the second electrical terminal, with the ramp retained by the housing lock in the locked position to secure the first housing to the second housing;

wherein the outer housing further comprises: a top surface that defines an aperture; at least one ramp disposed within the bore, adjacent to the aperture, the at least one ramp having a sloped portion that engages a ramped portion of the housing lock to bias the housing lock from the locked position to the unlocked position to enable the removal of the second housing from the first housing.

2. The connector of claim 1, wherein the housing lock further comprises:

a first arm coupled to a distal end of the inner housing, the first arm extending longitudinally to a proximal end of the inner housing; and a second arm coupled to the distal end of the inner housing, the second arm extending longitudinally to a proximal end of the inner housing, the second arm parallel to the first arm;

wherein the ramped portion connects the first arm to the second arm at the proximal end of the inner housing, the ramped portion having a negative slope such that the ramp of the second housing contacts the ramped portion to bias the housing lock into the unlocked position upon the insertion of the second housing into the first housing.

3. The connector of claim 2, wherein at least a portion of the housing lock is disposed in the aperture when the housing lock is in the unlocked position.

4. The connector of claim 3, wherein the at least one ramp engages the ramped portion of the housing lock to bias the housing lock into the unlocked position when the inner housing is moved relative to the outer housing.

5. The connector of claim 4, wherein the ramp on the second housing moves the inner housing relative to the outer housing.

6. The connector of claim 5, wherein the outer housing includes a slot defined in a bottom surface, and the inner housing includes a tab that extends from a bottom surface, the tab slideable within the slot to enable the inner housing to move relative to the outer housing.

7. The connector of claim 6, wherein the outer housing further comprises:

a lip operable to retain the inner housing within the outer housing; and at least one rail that guides the movement of the inner housing relative to the outer housing.

8. The connector of claim 7, wherein the second housing includes a wall that extends about at least a portion of the second housing to prevent the accidental disengagement of the second housing from the first housing.

9. The connector of claim 1, wherein the housing lock is cantilevered relative to the inner housing.

10. A connector comprising:

a male housing that surrounds a male terminal at a distal end, the male housing having a proximal end that includes a ramp;

a first female housing that surrounds a female terminal, the first female housing including a housing lock cantilevered relative to the first female housing, the housing lock movable between a locked position and an unlocked position, the first female housing including a tab that extends from a surface opposite the housing lock; and a second female housing that surrounds at least a portion of the first female housing, the second female housing defining an aperture on a first surface and including at least one ramp having a sloped surface that extends into the aperture, the second female housing defining a slot on a surface opposite the aperture that receives the tab to enable the first female housing to move relative to the second female housing, the aperture and the at least one ramp cooperating with the housing lock to move the housing lock from the locked position to the unlocked position when the first female housing moves from a first position to a second position relative to the second female housing;

wherein the ramp of the male housing and the at least one ramp of the second female housing contact a ramped portion of the housing lock to bias the housing lock from the locked position to the unlocked position upon the insertion of the male housing into the first female housing.

11. The connector of claim 10, wherein the housing lock further comprises:

a first arm coupled to a distal end of the first female housing, the first arm extending longitudinally to a proximal end of the first female housing; and a second arm coupled to the distal end of the first female housing, the second arm extending longitudinally to a proximal end of the first female housing, the second arm parallel to the first arm;

wherein the ramped portion connects the first arm to the second arm at the proximal end of the first female housing, the ramped portion having a negative slope such that the at least one ramp of the second female housing contacts the ramped portion to bias the housing lock into the unlocked position upon the movement of the first female housing from the first position to the second position.

12. The connector of claim 10, wherein the ramp on the male housing moves the first female housing relative to the second female housing.

13. The connector of claim 12, wherein the second female housing further comprises:

a lip operable to retain the first female housing within the second female housing; and at least one rail that guides the movement of the first female housing relative to the second female housing.

14. The connector of claim 13, wherein the proximal end of the male housing further comprises at least one rail offset from a longitudinal axis of the male housing, and the first female housing includes at least one groove that slideably receives the at least one rail to guide the male housing into the first female housing.

15. The connector of claim 14, wherein the male housing includes a wall that extends about at least a portion of the male housing to prevent the accidental disengagement of the male housing from the first female housing.

16. A connector comprising:

a male housing that surrounds a male terminal at a distal end, the male housing having a proximal end that includes a ramp having a sloped surface;

a first female housing that surrounds a female terminal, the first female housing including a housing lock cantilevered relative to the first female housing, the housing lock movable between a locked position and an unlocked position and including a ramped portion, the first female housing including a tab that extends from a surface opposite the housing lock;

a second female housing that surrounds at least a portion of the first female housing, the second female housing defining an aperture on a first surface and including at least one ramp that extends into the aperture, the second female housing defining a slot on a surface opposite the aperture that receives the tab to enable the first female housing to move relative to the second female housing; and wherein the ramp of the male housing contacts the ramped portion of the housing lock to move the housing lock from the locked position to the unlocked position upon the insertion of the male housing into the first female housing, and the aperture and the at least one ramp of the second female housing cooperate with the ramped portion to move the housing lock from the locked position to the unlocked position when the ramp of the male housing is pulled away from the first female housing, and thereby moves the first female housing from a first position to a second position relative to the second female housing, to release the male housing from the first female housing.

17. The connector of claim 16, wherein the ramp on the male housing moves the first female housing relative to the second female housing.

18. The connector of claim 17, wherein the ramp on the male housing is retained in an aperture defined in the housing lock, which secures the male housing to the female housing.

19. The connector of claim 18, wherein the male housing includes a wall that extends about at least a portion of the male housing to prevent the accidental disengagement of the male housing from the first female housing.

* * * * *